US006163914A

United States Patent [19]

Martin

[11] Patent Number: 6,163,914

[45] Date of Patent: Dec. 26, 2000

[54] DEVICE FOR CLEANING TUBS WHICH CONTAIN LIQUID IN WORKING CONDITIONS, AND USE OF THE DEVICE IN A WASHER CHAMBER

[76] Inventor: Kurt Martin, Wacholderweg 52, D-29664 Walsrode, Germany

[21] Appl. No.: 09/242,420

[22] PCT Filed: Aug. 14, 1997

[86] PCT No.: PCT/EP97/04470

§ 371 Date: Jun. 4, 1999

§ 102(e) Date: Jun. 4, 1999

[87] PCT Pub. No.: WO98/07936

PCT Pub. Date: Feb. 26, 1998

[30] Foreign Application Priority Data

Aug. 16, 1996 [DE] Germany ..... 196 33 057

[51] Int. Cl.[7] ..... E04H 4/16

[52] U.S. Cl. ..... 15/1.7; 210/169; 210/416.2

[58] Field of Search ..... 15/1.7, 320, 363, 15/383, 387, 419; 210/169, 416.2

[56] References Cited

U.S. PATENT DOCUMENTS

| | | |
|---|---|---|
| 3,254,355 | 6/1966 | Shaw . |
| 4,449,265 | 5/1984 | Hoy . |
| 4,558,479 | 12/1985 | Greskovics et al. . |
| 4,589,986 | 5/1986 | Greskovics et al. . |
| 4,920,599 | 5/1990 | Rief ..... 15/1.7 |
| 5,099,535 | 3/1992 | Chauvier et al. . |
| 5,337,434 | 8/1994 | Erlich . |

FOREIGN PATENT DOCUMENTS

| | | |
|---|---|---|
| 2 535 226 | 5/1984 | France . |
| 2 549 745 | 1/1985 | France . |
| 2 655 575 | 6/1991 | France . |
| 33 20 923 A1 | 12/1984 | Germany . |
| 35 02 503 A1 | 8/1985 | Germany . |
| 38 08 407 A1 | 9/1989 | Germany . |
| 31 51 529 C2 | 1/1992 | Germany . |
| 1 459 853 | 12/1976 | United Kingdom . |
| 2153208 | 8/1985 | United Kingdom . |

*Primary Examiner*—Gary K. Graham
*Attorney, Agent, or Firm*—Pauley, Petersen, Kinne & Fejer

[57] ABSTRACT

An apparatus for cleaning tubs filled with a liquid, wherein a suction device which can be moved by a drive communicating with a delivery pipe is arranged on a base of the tub. The drive is operated by a pressurized fluid and drives a water wheel which is non-positively coupled to a displacement device contacting the base of the tub. A filter unit is connected to a suction pipe of the suction device. The suction device has a guide system for to and from movements and a two-way valve is actuated by limit switches for alternative opening of a passage for reversing movement of the water wheel. The apparatus can be used in a washer chamber of an aeration plant.

14 Claims, 4 Drawing Sheets

DEVICE FOR CLEANING TUBS WHICH CONTAIN LIQUID IN WORKING CONDITIONS, AND USE OF THE DEVICE IN A WASHER CHAMBER

BACKGROUND OF THE INVENTION

1. Field of the Invention

This invention relates to an apparatus for cleaning tubs which contain liquid under operating conditions, which is preferably used, in particular, for washer chambers of an aeration plant but also for water containers in cooling towers or cooling water reservoirs in an air conditioning plant where a constant supply of liquid exists.

2. Description of Prior Art

During operation of washer chambers of, in particular, an aeration plant, deposits settle on bases of the tubs in which a certain level of liquid is continuously maintained and thus lead to silting of the respective liquid, generally water. Chemicals are added, for example to prevent lime deposits and growth of algae, but the chemicals are only effective for a short period and also result in dead algae. Such plant therefore must be shut down and cleaned from time to time with or without chemicals, generally by hand. This is carried out at least every fortnight with washer chambers of humidifiers or with water containers of cooling towers.

Great Britain Patent Reference GB 1 459 853 discloses an automatic cleaner for swimming pools wherein a suction device which can be moved by a drive communicating with a delivery pipe is arranged on the base of the tub, and the drive is operated by a pressure fluid and drives a water wheel which is non-positively coupled to a displacement means contacting the base of the tub and with a filter unit which is connected to a suction pipe. The base of the swimming pool has to be at such an inclination that the suction device equipped with three wheels cannot be overturned as it moves. The suction device also comprises a collecting bag for aspirated components, which constantly has to be opened periodically.

German Patent Reference DE-C2-31 51 529 discloses an apparatus for removing sediment from a precipitation tank in which sediment from a liquid to be clarified settles during operation. A dirt collecting device can be submerged in the liquid. A switching device has a first part capable of moving with respect to a second part, with a device for alternately stopping the movement of each of the two parts with respect to the container. The unstopped part can be moved with respect to the container and with respect to the stopped part. A driving device moves the unstopped part with respect to the other part, wherein the dirt collecting device can be moved over the container base during operation. The switching device can be submerged in the liquid in the vicinity of the sediment deposited therein and the dirt collecting device is arranged on the switching device. The stopping device has a clamping device actuable by liquid pressure, a diaphragm possessing an inlet for the supply and discharge of liquid for expansion and compression of the diaphragm, and a clamping plate which can be moved during expansion of the diaphragm into a position in which its movement and movement of the associated part is stationary with respect to the container.

SUMMARY OF THE INVENTION

One object of this invention is to improve a device according to Great Britain Patent Reference GB 1 459 853 so that it can be operated continuously and allows a predetermined area to be cleaned without constantly stopping.

This object is achieved with an apparatus having characteristics described in the following specification and in the claims.

This invention also relates to use of the apparatus according to this invention, in washer chambers.

This object is achieved by an apparatus for the cleaning of tubs, into which liquid flows under operating conditions, having the characteristics of the claims.

BRIEF DESCRIPTION OF THE DRAWINGS

This invention is described in more detail hereinafter by referring to a washer chamber of an aeration plant with reference to the drawings wherein.

DESCRIPTION OF PREFERRED EMBODIMENTS

Figure 1:
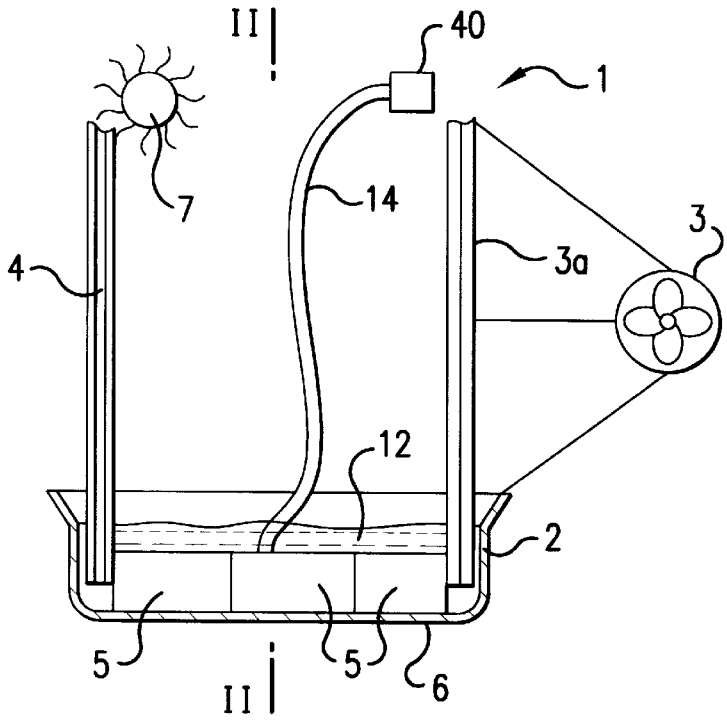
FIG. 1 is a longitudinal cross section taken through a washer chamber of a humidifier.

The washer chamber 1 shown in FIG. 1 comprises a tub 2 arranged on the base 6. A fan 3 for incoming air is arranged outside the washer chamber 1 on one lateral wall. Rectifier profiles 3a for the incoming air supplied by the fan 3 are arranged on the side of the lateral wall of the washer chamber 1 facing the fan 3. Drainage profiles 4 are arranged on an outlet side with the lower end projecting into the tub 2. On the base 6 of the tub 2, a suction device 5 is arranged movably over the base 6 of the tub 2. The suction device 5 preferably covers a cross section of the tub 2 and is preferably arranged so that the suction device 5 can move to and from parallel to the rectifier profiles 3a and the drainage profiles 4 in the tub 2, as indicated by the double arrow in FIG. 2.

A brush unit 7 is arranged inside the washer chamber 1 in such a way that bristles of the brush unit 7 can enter the entry region of the drainage profiles 4, the drainage profiles 4 being mechanically cleaned of deposits during up and down movement of the brush unit 7. The brush unit 7 can comprise rigidly arranged brushes with rigid bristles and/or also a brush roller with flexible and/or rigid bristles.

Figure 2:
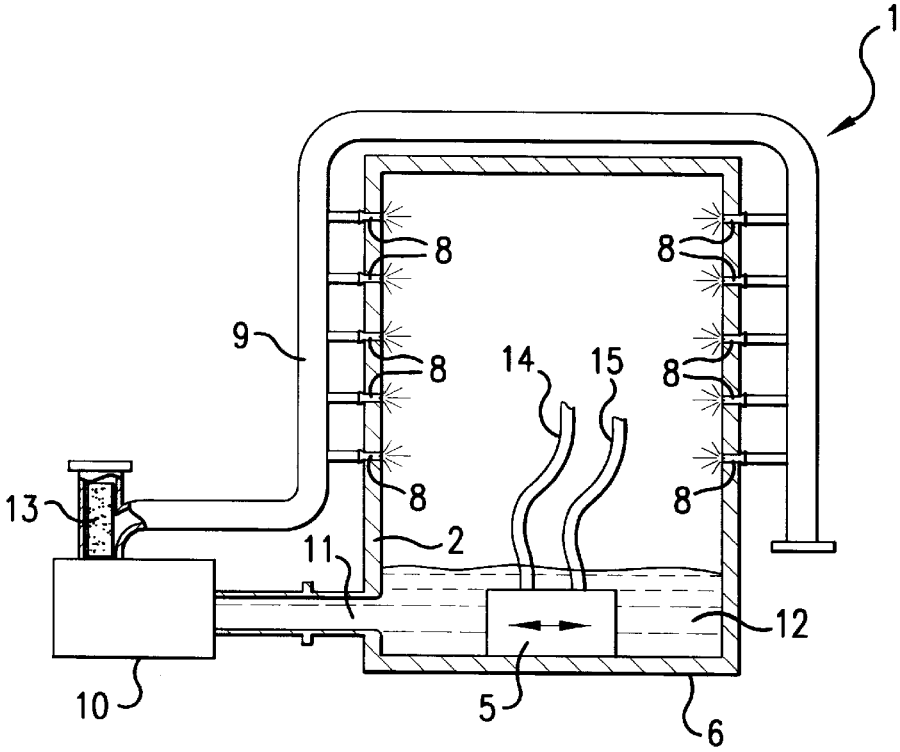
FIG. 2 is a section taken along line II—II, as shown in FIG. 1, of the washer chamber.

Spray nozzles 8 are arranged in the washer chamber 1 between the front and rear end face, distributed over the height in the lateral walls and directed towards one another in a plane, as shown in FIG. 2. The spray nozzles 8 are connected via a piping system 9 to a pump 10 of which the suction nozzle 11 opens in a lateral or end wall of the tub 2, beneath the always present level of liquid 12 in the tub 2. A preferably exchangeable filter 13 can be arranged in front of or behind the pump 10 in the suction nozzle 11 or in the piping system 9. In one preferred embodiment, the filter 13 is arranged in the straight part of a diverting elbow, as shown in FIG. 2. Thus a rapid exchange of a circular filter adapted to the pipe diameter can be achieved by opening the lid, removing the circular filter, and optionally flushing thereof and reinsertion or insertion of a new filter into the path of flow and re-closure of the lid.

The suction device 5 can be connected by a flexible suction pipe 14 to a conventional filter plant, not shown, which contains a delivery pipe 15 for recirculating the cleaned liquid, such as water, in addition to a filter 41, valves and pumps 40. The filter plant can be so designed that the filter 13 is exchangeable and backwashable and comprises nozzles for drainage and silt removal, wherein valves, for example solenoid valves, controlled via time clocks can also perform an operating program, which is predetermined or is controlled on the basis of test parameters automatically and/or with interposition of sensors. As a filter plant of this type and developments thereof is widely known, they are not described in this specification. The cleaned liquid can be recirculated to the tub 2 by means of the delivery pipe 15 of the filter plant.

Figure 3:
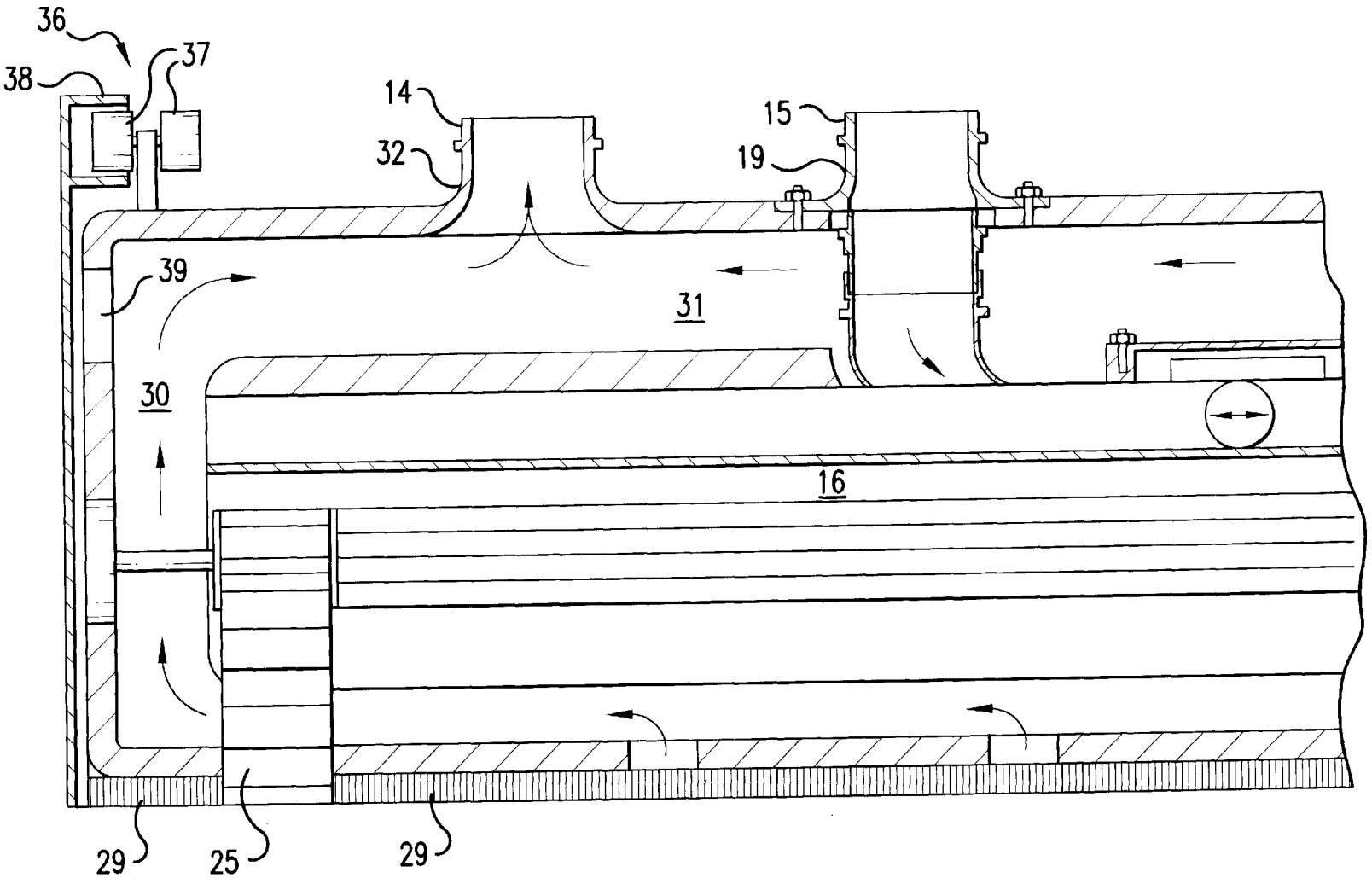
FIG. 3 is a partial section taken through a suction device, according to one embodiment of this invention.
Figure 5:
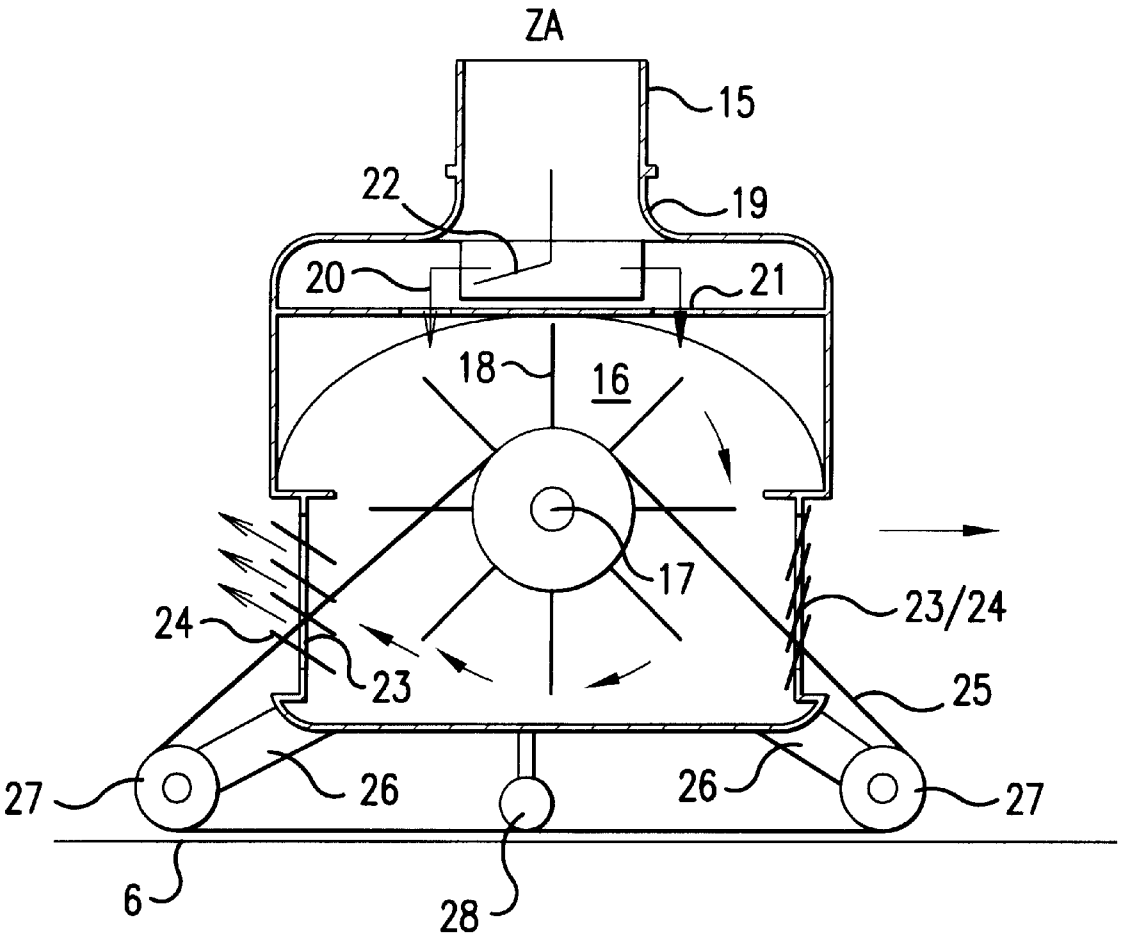
FIG. 5 is a section taken through a pressure chamber of the pressure device.

As already mentioned, the suction device 5 should be movable to and from within the tub 2. The water pressure supplied through the delivery pipe 15 from the pressure plant can preferably be used for this purpose. Thus, the suction device 5 contains a central pressure chamber 16, as shown in FIG. 3 and in FIG. 5, in which a water wheel 18 is arranged rotatably on an axis of rotation 17 or about a stationary axis. The delivery pipe 15 passes into a nozzle 19 which ends in two separate passages 20, 21 into the pressure chamber 16 arranged symmetrically with respect to the central axis ZA, as shown in FIG. 5, at a distance. The passages 20, 21 are preceded by a two-way valve 22 which selectively seals one of the two passages and opens the other or vice versa. Roughly in the 90° to 130° range and in the 230° to 270° range of the cross section the central pressure chamber 16 comprises longitudinal slots 23 with flaps 24, the flaps 24 being arranged movably in such a way that the flaps 24 close with flow against from above and open with flow against from below, as shown by the blackened arrow heads in FIG. 5.

In the embodiment according to FIG. 3 and FIG. 5, the axis 17 or the water wheel 18 is coupled to a displacement means comprising belts, preferably two mutually spaced toothed belts 25, only one of which is shown in the partial section in FIG. 3. The toothed belts 25 are guided by return rollers or return toothed wheels 27 mounted rotatably on the housing of the suction device 5 preferably at the end of extension arms 26 and can also be guided at least via a support roller or a support gearwheel 28 in the intermediate region.

The toothed belt 25 can preferably also have teeth on both sides to increase the friction on the base 6 of the tub 2. With a design of this type, inclinations of the base and small steps pose no problems.

Brushes 29, as shown in FIG. 3, which are stationary and/or rotate and/or perform up and down and/or to and from movements and contact the base 6 of the tub 2 are positioned between and to the side of the displacement means. To compensate wear, the brushes 29 can be adjustable and can optionally also be driven, preferably via a clutch with the drive of the displacement means, optionally with interposition of a gear for varying the speed of movement or the speed of rotation or the frequency of the proposed rotational and/or to and from movements of the brushes 29. Rotating brushes can also be used as displacement means.

Suction chambers 30, with a suction chamber on only one side, which communicate with the connecting nozzles 32 of the suction pipe 14 via a duct 31 arranged above the central chamber 16 are arranged, in particular, on either side of the central pressure chamber 16. In the direction of the base 6 of the tub 2, the suction chambers 30 have intake orifices 33 in the vicinity of the brushes 29, as shown in FIG. 4.

Figure 4:
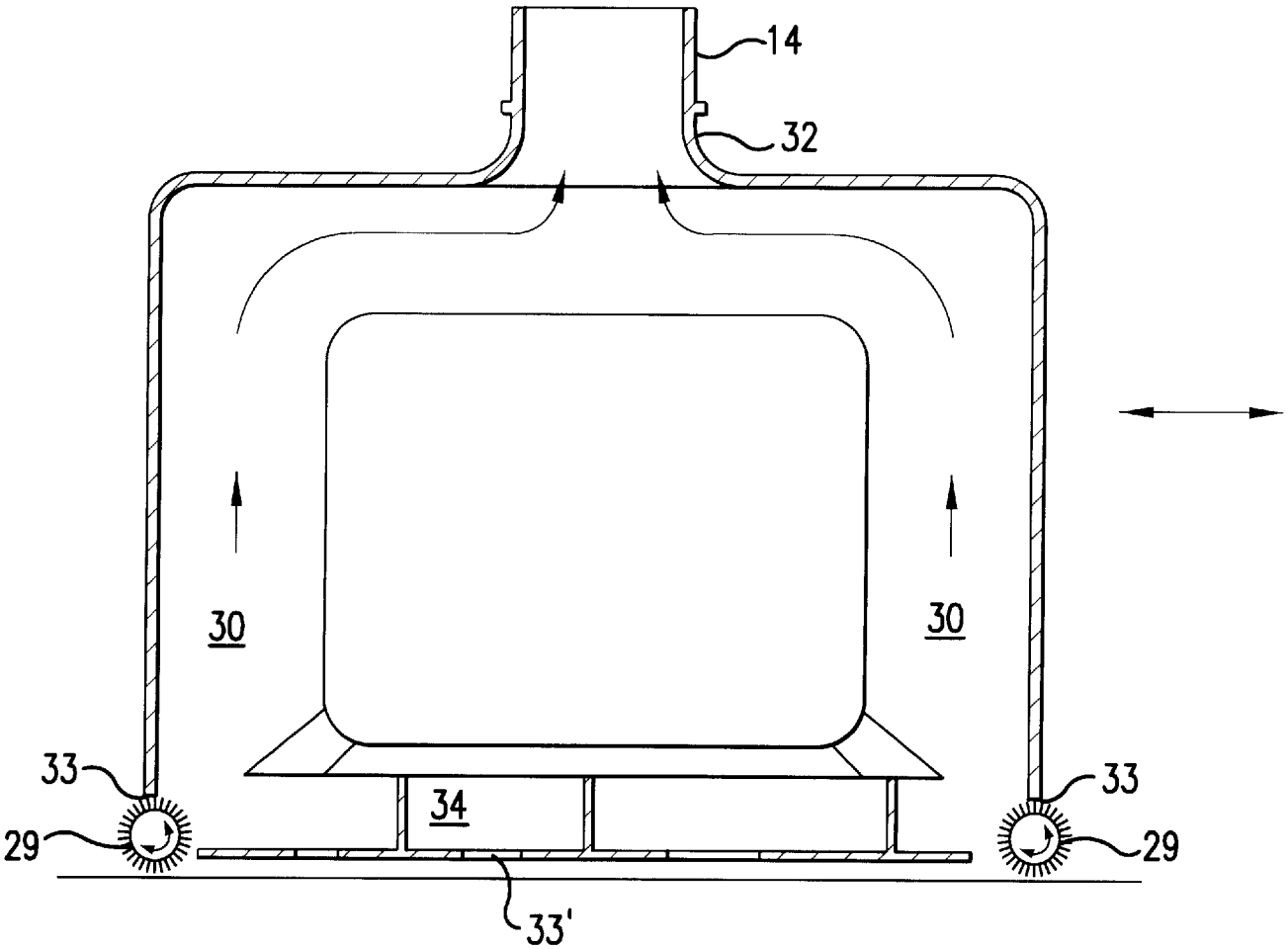
FIG. 4 is a section taken through a suction chamber of the suction device.

At least one duct 34, as shown in FIG. 4, which is connected at each end to the suction chambers 30 can also be provided beneath the central pressure chamber 16. The ducts 34 can have slot-shaped and/or annular intake apertures 33'.

As mentioned, the suction device 5 should preferably be designed so as to cover a cross section of the tub 2, preferably with the smallest dimensions. This can optionally be achieved with lateral projections or extension arms, not shown in the drawings, which should then also carry stationary or moving brushes. To guarantee directed movement and to prevent tilting of the suction device 5 during its longitudinal movements within the tub 2, the suction device 5 can be designed with a guide system which also includes arrangements in the lateral walls of the washer chamber 1. FIG. 3 illustrates a possible guide system 36 of this type which comprises two spaced guide rollers 37, only one of which is shown in the drawings, on each end face of the suction device 5 and one respective guide rail 38 formed in the lateral walls of the tub 2, preferably above the water level 12, and brush devices can also be provided for cleaning the guide rails 38, not shown in the drawings. Any other desired known guide can also be used, for example also a remotely controlled system which allows the base aspirator any free or predetermined movement over the base, this being useful, in particular with relatively large tubs, where it would be difficult or impossible to handle a base aspirator covering a cross section.

If the cross section of a tub 2 is somewhat greater, several suction devices 5 can also be arranged side by side and can be coupled to one another in use. Each of the suction devices 5 can be virtually identical in construction and can be mutually coupled mechanically. However, it is also possible to arrange, in particular, smaller modules at each end of the suction device 5, wherein the drive of the water wheel 18 can be transmitted to the secondary modules via a clutch to the rotatable axis 17. A flexible connecting pipe can optionally connect the suction chamber 30 to corresponding chambers of the secondary modules. This can also be effected by a direct connection via a closable orifice 39, as shown in FIG. 3, in the suction chamber 30.

The device according to this invention for the cleaning of tubs operates as follows. With a suction device 5 arranged on the base of the tub 2 and designed in accordance with the foregoing description, cleaned liquid, such as water, is supplied through the delivery pipe 15 into the suction device 5. Water under pressure is supplied to the blades of the water wheel 18 to the side of the central axis ZA, depending on the position of the two-way valve 22. The water wheel 18 is therefore set into rotation and the flow of water indicated by closed arrows in FIG. 5 is achieved. This flow closes the flaps 24 of the slots 23 as it descends, so a closed wall is formed. During further movement to the opposite side, the same stream opens the flaps 24 of the slots 23 in the range of the 230° to 270° position so that the stream of water under pressure issues from the housing and the pressure is reduced. The displacement means, at least two toothed belts 25 arranged at a distance from one another in this case, is also moved by the rotational movement of the water wheel and, with the direction of flow illustrated by the arrows in FIG. 5, the suction device 5 moves to the right as shown in FIG. 5. This movement is assisted by the discharge of the stream of water under pressure through the opened flaps 24 of the slots 23. If the suction device 5 driven in this way reaches one end face of the tub 2, a limit switch, not shown, on the suction device 5 in contact with the end wall actuates the two-way valve 22 so that the passage 21 is closed and the passage 20 is opened so that a fresh supply of the stream of water under pressure in the direction of the open arrow in FIG. 5 causes a reversal of the direction of movement of the water wheel 18, and a reversal of movement is also achieved. The same applies on attainment of the other end face of the tub 2. The suction device 5 therefore moves automatically over the entire base of the tub 2, moving continuously to and from, and keeps the tub 2 free from deposits caused by the aspiration and the mechanical cleaning by the brushes.

The speed of movement can be influenced by changing the water pressure supplied, optionally also by controllable flow control valves. The base 6 of the tub 2 is continuously treated mechanically by the brushes 29 so deposits are unable to settle on the base 6 of the tub 2. Falling particles are swirled from the base 6 so the falling particles can be grasped particularly easily by the suction stream. The particularly endangered edge regions are aspirated more intensively by the arrangement of the suction chambers at the ends of the apparatus, so deposits are more strictly prevented at critical edge regions.

Since there is virtually only cleaned liquid, such as water, in the tub 2, the shelf lives of the spray nozzles 8 in the washer chamber 1, which are also arranged laterally with protection, are invariably charged with cleaned water so deposits cannot form either internally or externally. For this reason, it is not essential to provide a filter in the supply pipe, let alone at the outlet of the suction nozzle where a filter is arranged in conventional devices. The use of a filter which can be exchanged, in particular, in the manner described above additionally increases the shelf lives of the spray nozzles 8. The brush unit 7 which can be displaced up and down cleans the drainage profiles 4 in their inlet region which is particularly endangered by deposits, so the shelf life thereof is also extended considerably prior to general cleaning.

To sum up, the characteristics according to this invention allow continuous cleaning of inorganic and/or organic deposits from the tub 2 and allow the shelf lives of devices containing the subject of this invention to be substantially extended.

What is claimed is:

1. In an apparatus for cleaning a tub filled with a liquid, wherein a suction device (5) which can be moved by a drive communicating with a delivery pipe (15) is arranged on a base (6) of the tub (2), wherein the drive is operated by a pressure fluid and drives a water wheel (18) coupled to a displacement means contacting the base (6) of the tub (2) and with a filter unit which is connected to a suction pipe (14), the improvement comprising: the suction device (5) having a guide system (36) controlling movements of the suction device (5) and a two-way valve (22) actuated by limit switches for opening one of a first passage (20) and a second passage (21) for reversing a movement of the water wheel (18), the suction device (5) connected to the suction pipe (14) of the filter unit having a pump and the suction device (5) comprising at least one suction chamber (30) communicating with the suction pipe (14) and a pressure chamber (16) communicating with the delivery pipe (15).

2. In the apparatus according to claim 1, wherein the suction device (5) comprises a plurality of cleaning brushes (29).

3. In the apparatus according to claim 1, wherein the displacement means comprises at least two mutually spaced toothed belts (25).

4. In the apparatus according to claim 3, wherein the pressure chamber (16) comprises a plurality of slots (23) positioned on mutually opposed wall faces.

5. In the apparatus according to claim 4, wherein a plurality of movable closure flaps (24) are positioned over the slots (23).

6. In the apparatus according to claim 5, wherein the suction device (5) covers a cross-sectional width of the tub (2).

7. In the apparatus according to claim 6, wherein the suction device (5) has a base profile adapted to a cross-sectional base profile of the tub (2).

8. In the apparatus according to claim 1 wherein the apparatus is operated in a washer chamber.

9. In the apparatus according to claim 1, wherein the suction device (5) comprises a plurality of cleaning brushes (29).

10. In the apparatus according to claim 1, wherein the displacement means comprises at least two mutually spaced toothed belts (25).

11. In the apparatus according to claim 1, wherein the suction device (5) covers a cross-sectional width of the tub (2).

12. In the apparatus according to claim 11, wherein the suction device (5) has a base profile adapted to a cross-sectional base profile of the tub (2).

13. In an apparatus for cleaning a tub filled with a liquid, wherein a suction device (5) which can be moved by a drive communicating with a delivery pipe (15) is arranged on a base (6) of the tub (2), wherein the drive is operated by a pressure fluid and drives a water wheel (18) coupled to a displacement means contacting the base (6) of the tub (2) and with a filter unit which is connected to a suction pipe (14), the improvement comprising: the suction device (5) having a guide system (36) controlling movements of the suction device (5) and a two-way valve (22) actuated by limit switches for opening one of a first passage (20) and a second passage (21) for reversing a movement of the water wheel (18) and the suction device (5) having a pressure chamber (16) comprising a plurality of slots (23) positioned on mutually opposed wall faces.

14. In the apparatus according to claim 13, wherein a plurality of movable closure flaps (24) are positioned over the slots (23).

* * * * *